US011655975B2

(12) United States Patent
Sohn et al.

(10) Patent No.: US 11,655,975 B2
(45) Date of Patent: May 23, 2023

(54) OIL LAMP POST CAP HOLDER

(71) Applicant: DeckWicks LLC, Upper Marlboro, MD (US)

(72) Inventors: Eric A. Sohn, Upper Marlboro, MD (US); Kristine K. Sohn, Upper Marlboro, MD (US)

( * ) Notice: Subject to any disclaimer, the term of this patent is extended or adjusted under 35 U.S.C. 154(b) by 9 days.

(21) Appl. No.: 17/551,405

(22) Filed: Dec. 15, 2021

(65) Prior Publication Data

US 2022/0252253 A1 Aug. 11, 2022

Related U.S. Application Data

(60) Provisional application No. 63/129,862, filed on Dec. 23, 2020.

(51) Int. Cl.
*F21V 37/00* (2006.01)

(52) U.S. Cl.
CPC ..... *F21V 37/0016* (2013.01); *F21V 37/002* (2013.01); *F21V 37/0008* (2013.01)

(58) Field of Classification Search
CPC ... F21V 37/0016; F21V 37/008; F21V 37/002
See application file for complete search history.

(56) References Cited

U.S. PATENT DOCUMENTS

| | | | | |
|---|---|---|---|---|
| 3,222,509 | A | 12/1965 | Thedford | |
| 3,866,034 | A | 2/1975 | Russo | |
| 5,421,556 | A | 6/1995 | Dodge et al. | |
| 6,076,807 | A | 6/2000 | Spence | |
| 6,585,398 | B1 | 7/2003 | Haddad | |
| 8,281,514 | B2 | 10/2012 | Fleming | |
| 10,021,875 | B2 | 7/2018 | Formico et al. | |
| 2002/0125468 | A1 | 9/2002 | Fischer | |
| 2003/0122115 | A1 | 7/2003 | Ernst | |
| 2007/0015097 | A1* | 1/2007 | Baker | F23D 3/18 431/310 |
| 2011/0198550 | A1* | 8/2011 | Howard | F21S 13/10 431/328 |
| 2011/0198551 | A1* | 8/2011 | Howard | F23D 3/18 431/344 |
| 2013/0114244 | A1 | 5/2013 | Formico et al. | |
| 2014/0063782 | A1 | 3/2014 | Shapiro et al. | |
| 2014/0362560 | A1 | 12/2014 | Formico et al. | |
| 2018/0328074 | A1 | 11/2018 | Sachakov | |

* cited by examiner

*Primary Examiner* — Mariceli Santiago
(74) *Attorney, Agent, or Firm* — IPEC/MIPLRC

(57) ABSTRACT

The present invention is a lamp apparatus that includes a reservoir for flammable liquids and a wick that can be incorporated with a post and within the cap of a post, such as a deck or fence post. The apparatus can include an external housing that attaches to a post and contains and conceals the internal components of the lamp apparatus within the external housing. This external housing can resemble and function as the cap of a post. The apparatus may allow for a user to remove a snuffing cap from the top of the external housing and ignite the lamp's wick, which then allows the post to function as a torch. The apparatus may also allow for a user to place the snuffing cap back on the top of the external housing to extinguish the flame and discreetly conceal that a lamp is contained within the cap of the post.

18 Claims, 9 Drawing Sheets

OIL LAMP POST CAP HOLDER

TECHNICAL FIELD OF THE INVENTION

The present invention relates to a lamp, and particularly to a lamp apparatus that can be inserted or otherwise incorporated within or as part of a post structure, such as a fence post, deck post, or banister post.

BACKGROUND

A lamp is usually an object that uses fuel or electricity to provide illumination. For thousands of years, humans have been using lamps that burn combustible fuels. Some lamps include a fuel reservoir and a wick that can become saturated with fuel. Many people use lamps in outdoor spaces to provide a variety of benefits. In addition to illumination, fuel lamps can help to deter pests through the use of certain types of fuels, and many people simply enjoy the aesthetics of light from a flame.

Many people like to place lamps along the perimeter of an outdoor space, as this can help to provide a wide dispersal of illumination and/or pest-repelling benefits. Many outdoor spaces have a fence that runs along their perimeters. Because many people have fences along the perimeter of an outdoor area and also want to have lamps along the perimeter, individuals have created devices that allow one to attach a lamp to a fence post. Some people choose to attach a lamp to a fence post because it is the only secure means by which to have a lamp in that area, such as if the outdoor surface or ground cannot provide an acceptable amount of support to safely and easily place a lamp within or on the ground. However, many of these lamp-holding devices can permanently damage a fence post when the device is screwed onto the fence post or otherwise attached to the post. Additionally, lamps attached to posts in this manner are usually not easily concealable if someone does not wish to have a lamp on display.

There are some fence posts that have electric lamps that are attached to or concealed within the cap of the fence post. Electric lamps in an outdoor space can have some downsides associated with exposure to the elements. Additionally, electric lamps need to be supplied with electricity, which requires solar panels, batteries, or wiring to be provided to each lamp. While there are apparatuses that consist of electric lamps that are recessed within a fence post and capable of being discreetly concealed, the current state of the art docs not include an apparatus that allows for incorporation and concealment of an oil lamp within a post.

The accompanying drawings, which are included to provide a further understanding of the disclosed subject matter, are incorporated in and constitute a pan of this specification. The drawings also illustrate embodiments of the disclosed subject matter, and together with the detailed description, serve to explain the principle embodiments of the disclosed subject matter. No attempt is made to show structural details in more detail than may be necessary for a fundamental understanding of the disclosed subject matter and various ways in which it may be practiced.

DETAILED DESCRIPTION

The present invention comprises a lamp that is inserted or otherwise incorporated within the cap of a post, such as the post of a fence, deck, or banister. The lamp has a reservoir that can hold flammable fuel, such as lamp oil. The lamp includes a wick collar that can be attached to the reservoir and also allows for the insertion of a wick into the reservoir. The wick can become saturated with fuel in the reservoir and allow for the controlled and gradual combustion of fuel. A user can ignite the wick to have the lamp serve as a light source. The lamp can be housed within a structure that serves as the cap of a post. Usually, the housing structure will have a base, a cover that secures to the base, and a removable snuffing cap that sits on top of the cover. This removable snuffing cap can serve multiple functions. The cap can be placed on the top of the housing structure when the lamp is not in use to protect and conceal the internal parts of the apparatus. The cap can be removed to expose the lamp's concealed wick when a user wishes to use the lamp. The cap can also be replaced on top of the housing structure and over the wick of the lamp to safely extinguish a flame. A purpose of this invention is to provide a discreet way to incorporate and conceal a lamp within the cap of a post. This invention represents a secure structure to house and support a lamp on top of a post.

Figure 1:
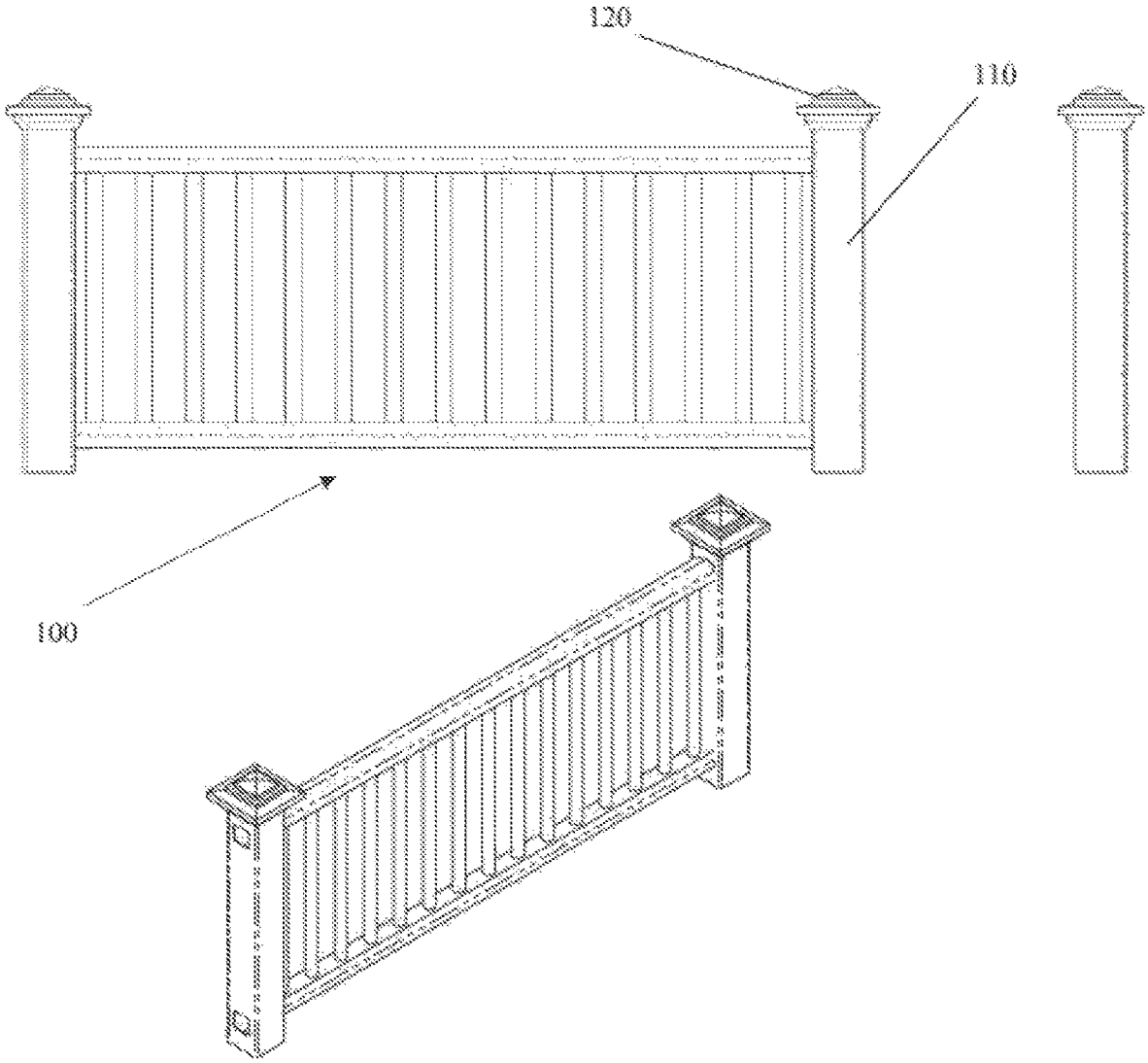
FIG. 1 is a perspective view and two side views of a section of a fence showing what a fence post could look like in one embodiment with the apparatus attached as the cap of the fence post.
Figure 2:
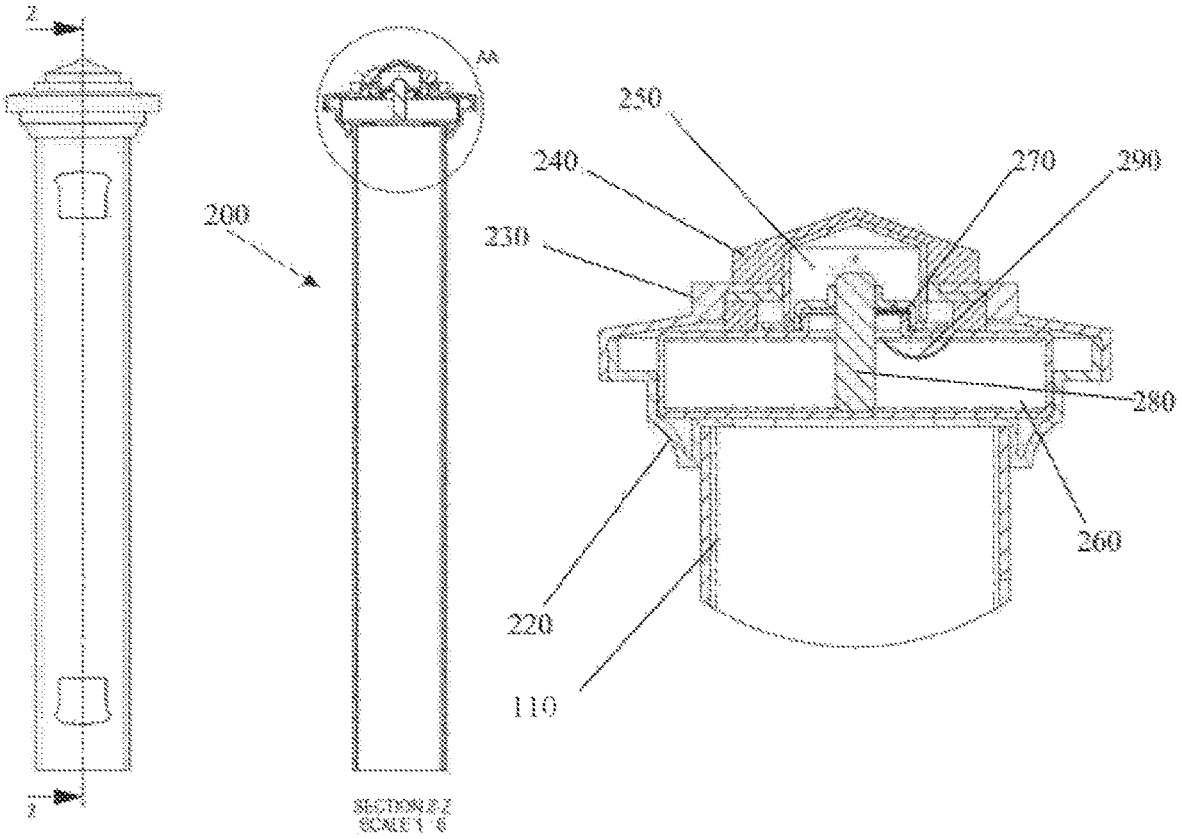
FIG. 2 is a side view, a cross-sectional view, and a magnified cross-sectional view of a fence post and the apparatus as envisioned in one embodiment.
Figure 3:
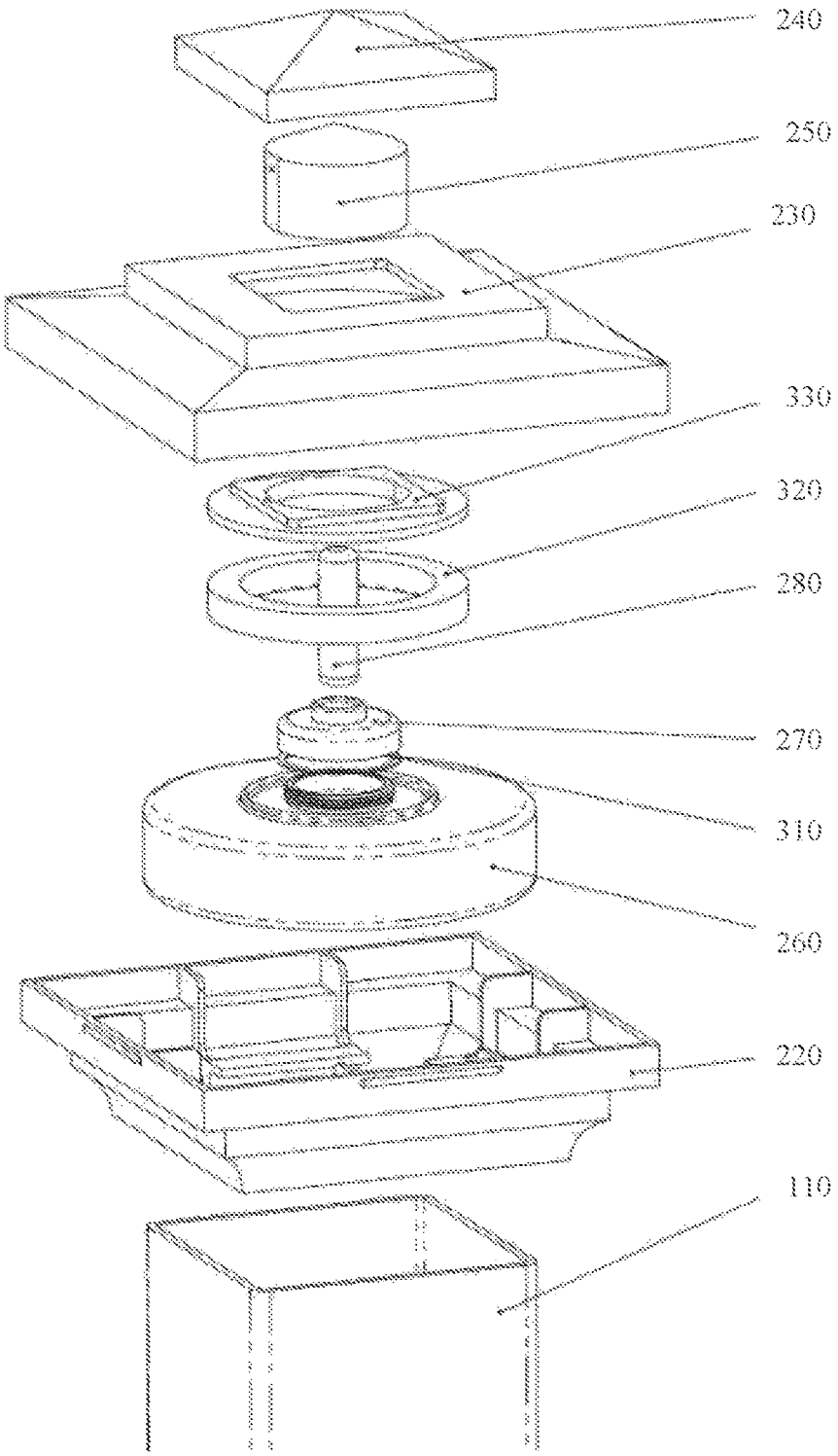
FIG. 3 is an exploded perspective view of the internal and external parts of the apparatus as envisioned in one embodiment.

Referring to FIG. 1, the present invention relates to a lamp apparatus 120 that can be placed on a post 110. The lamp apparatus 120 may have an external housing that looks like the cap of a post and which can include a base 220, a cover 230, and a snuffer cap 240 as shown in FIG. 2 and FIG. 3. The external housing can serve multiple purposes, including protecting the internal components of the lamp apparatus and discreetly concealing the lamp within the cap or post. Said external housing can house internal lamp components that can include a fuel reservoir 260, a lamp gasket 310, a wick collar 270, a wick 280, a grommet 320, and a cover ring 330. As shown in FIG. 2, the snuffer cap 240 can have a snuffer cap pipe 250 inserted into a cavity of said snuffer cap 240 and securely attached to said cavity, which can form a snuffer cap assembly. Said snuffer cap assembly can serve multiple purposes, including protecting and concealing the internal components of the apparatus, such as the wick 280, as well as safely snuffing a burning wick 280 when a user wishes to extinguish a lamp's flame.

Figure 4:
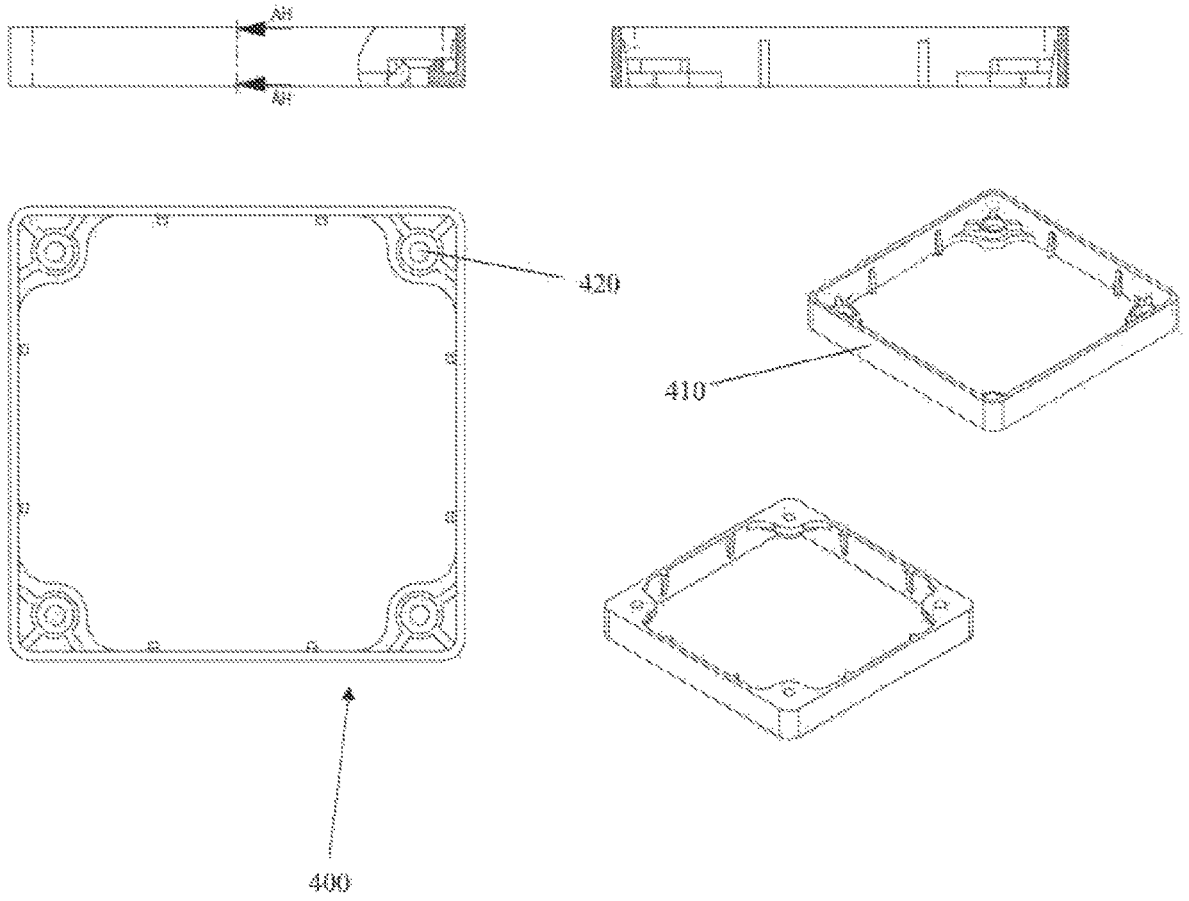
FIG. 4 shows a top view, side view, cross-sectional view, and two perspective views of an adapter that can be used to secure the apparatus to a post in some embodiments.

In another embodiment, a lamp apparatus could be attached to a flat surface of a horizontal deck rail. In this embodiment, said flat surface of the deck rail may require installation of an adapter 400, shown in FIG. 4, to allow a user to install a lamp apparatus. Said adapter 400 can include a multitude of guide holes 420 to assist with installation of said adapter 400 to a flat surface of a deck rail. In this embodiment, one could attach adapter 400 to the deck rail by aligning the guide holes 420 on a flat surface of the deck rail, and then using fasteners such as screws inserted through said guide holes 420 into said deck rail to secure said adapter 400 to said deck rail. In this embodiment, one could then attach a housing cover base 220 (shown in FIG. 3) to said adapter 400.

In an embodiment, the apparatus 200 includes a post 110. In this embodiment, an adapter 400 may not be required to attach base 220 to a post 110. This embodiment can be seen in a cross-sectional view in FIG. 2 and in an exploded view in FIG. 3. In an embodiment, one could assemble the apparatus 200 in the arrangement and orientations that are shown in FIG. 2 and FIG. 3.

In this embodiment, one could attach base 220 to post 110.

Figure 5:
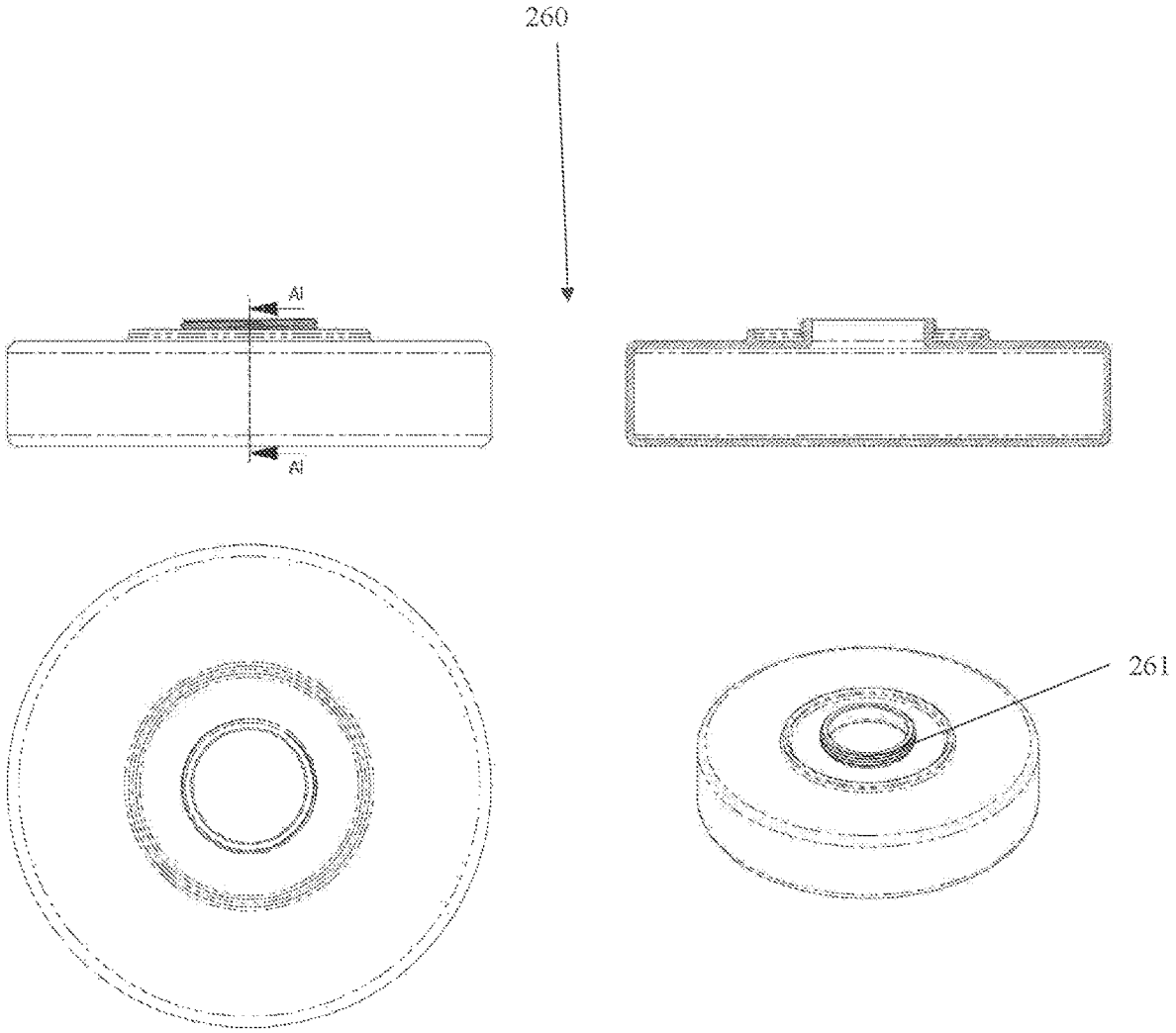
FIG. 5 shows a top view, side view, cross-sectional view, and a perspective view of a fuel reservoir that can be used to store lamp fuel, according to an embodiment.
Figure 6:
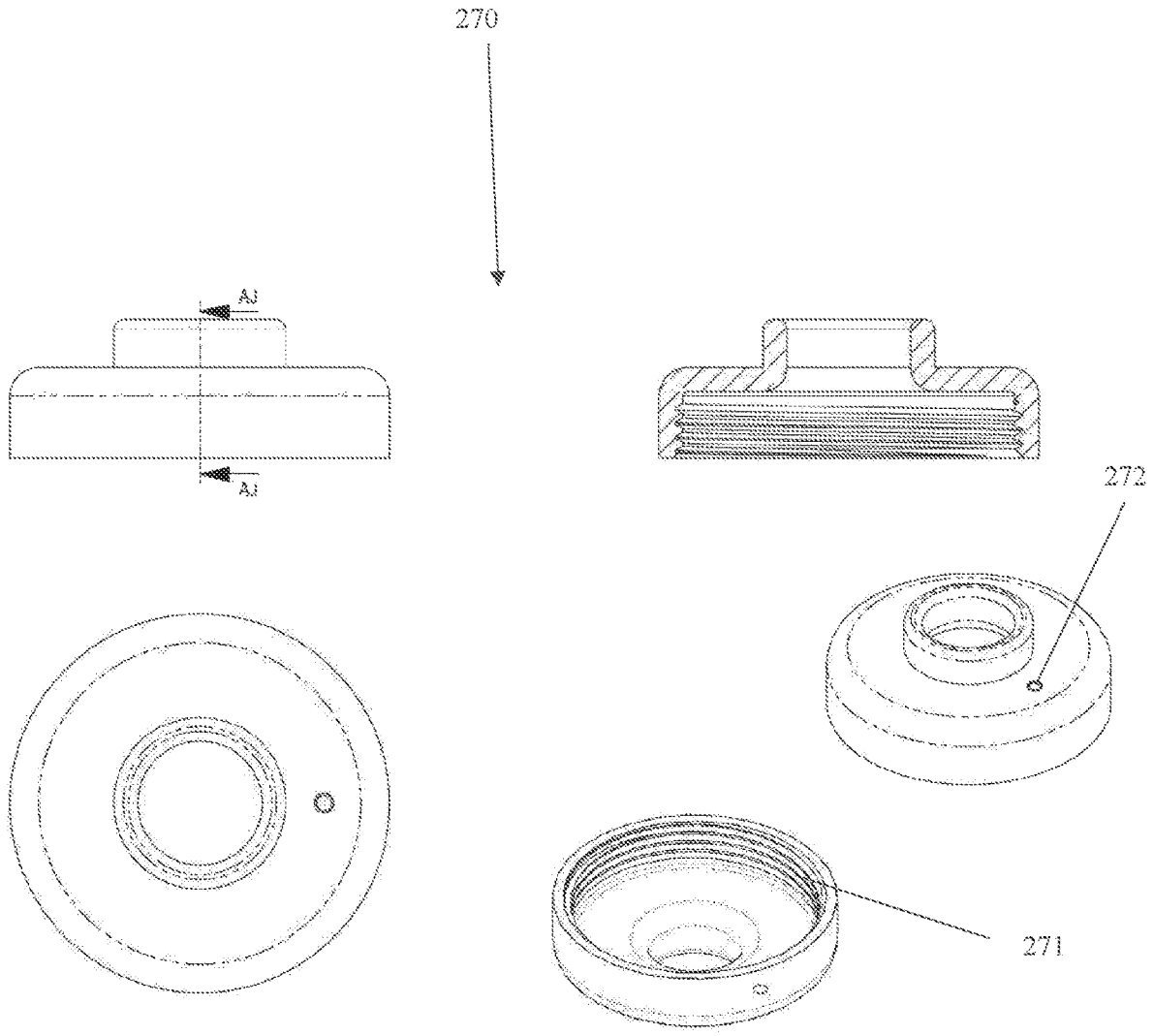
FIG. 6 shows a top view, side view, cross-sectional view, and two perspective views of a wick collar that can be attached to a fuel reservoir and hold a wick, according to an embodiment.
Figure 7:
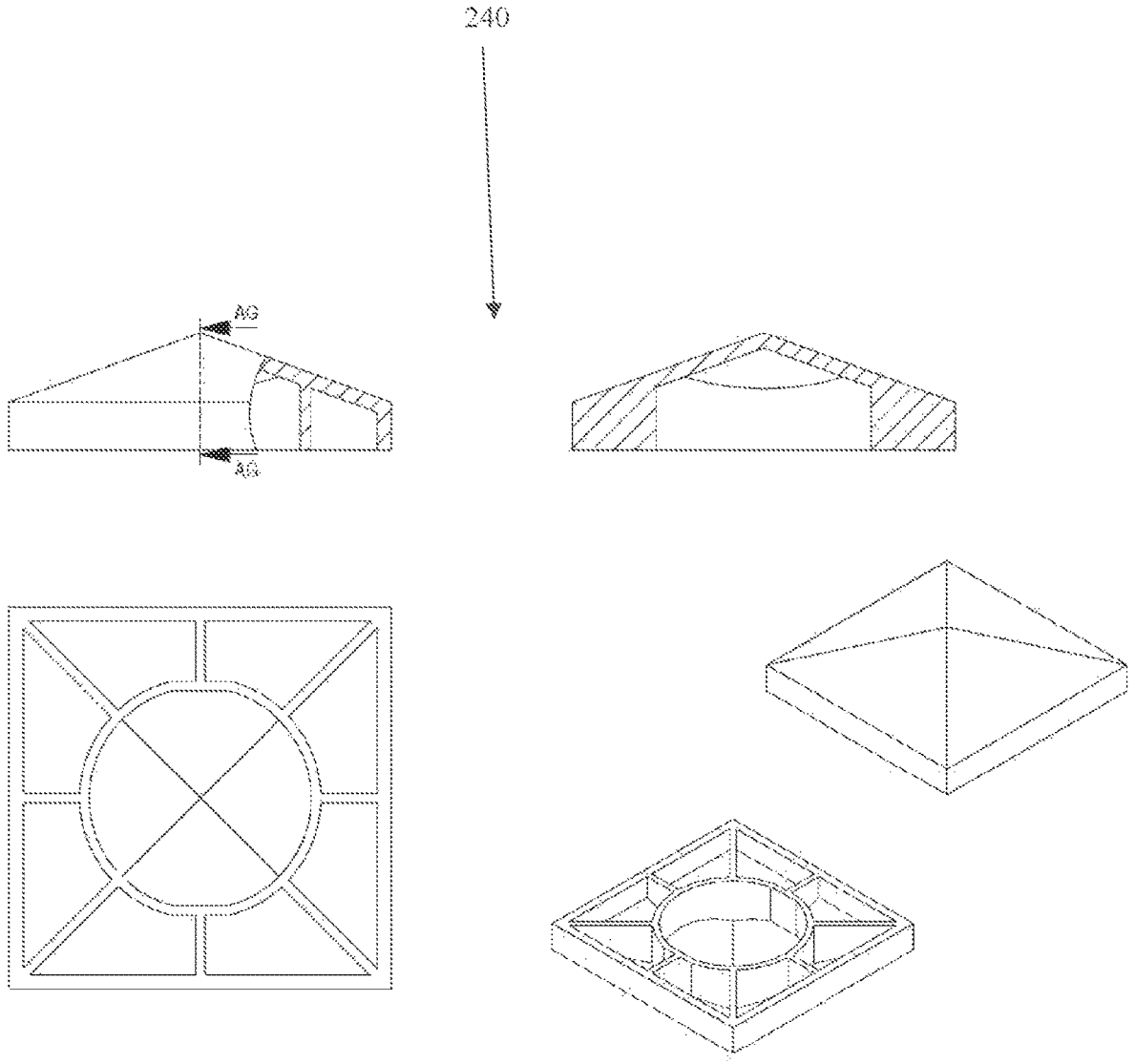
FIG. 7 shows a bottom view, side view, cross-sectional view, and two perspective views of a snuffer cap, according to an embodiment.

One could then place a fuel reservoir 260 inside the internal cavity of base 220, which can be sized and shaped to securely hold said fuel reservoir 260. Said fuel reservoir 260 should be constructed of a nonporous material such as metal or glass; however, other appropriate materials can be used as well. In this embodiment, said fuel reservoir 260 can have threading 261 (shown in FIG. 5) around the top opening of said fuel reservoir 260, which can allow for a wick collar 270 that can have threading 271 (shown in FIG. 6) to be secured to the threading 261 on top of said fuel reservoir 260. Before attaching wick collar 270 to fuel reservoir 260, one can install a lamp gasket 310 around the base of the threaded top opening of said fuel reservoir 260. Said lamp gasket 310 can be useful to ensure a secure and more air-tight seal between said fuel reservoir 260 and said wick collar 270.

Figure 8:
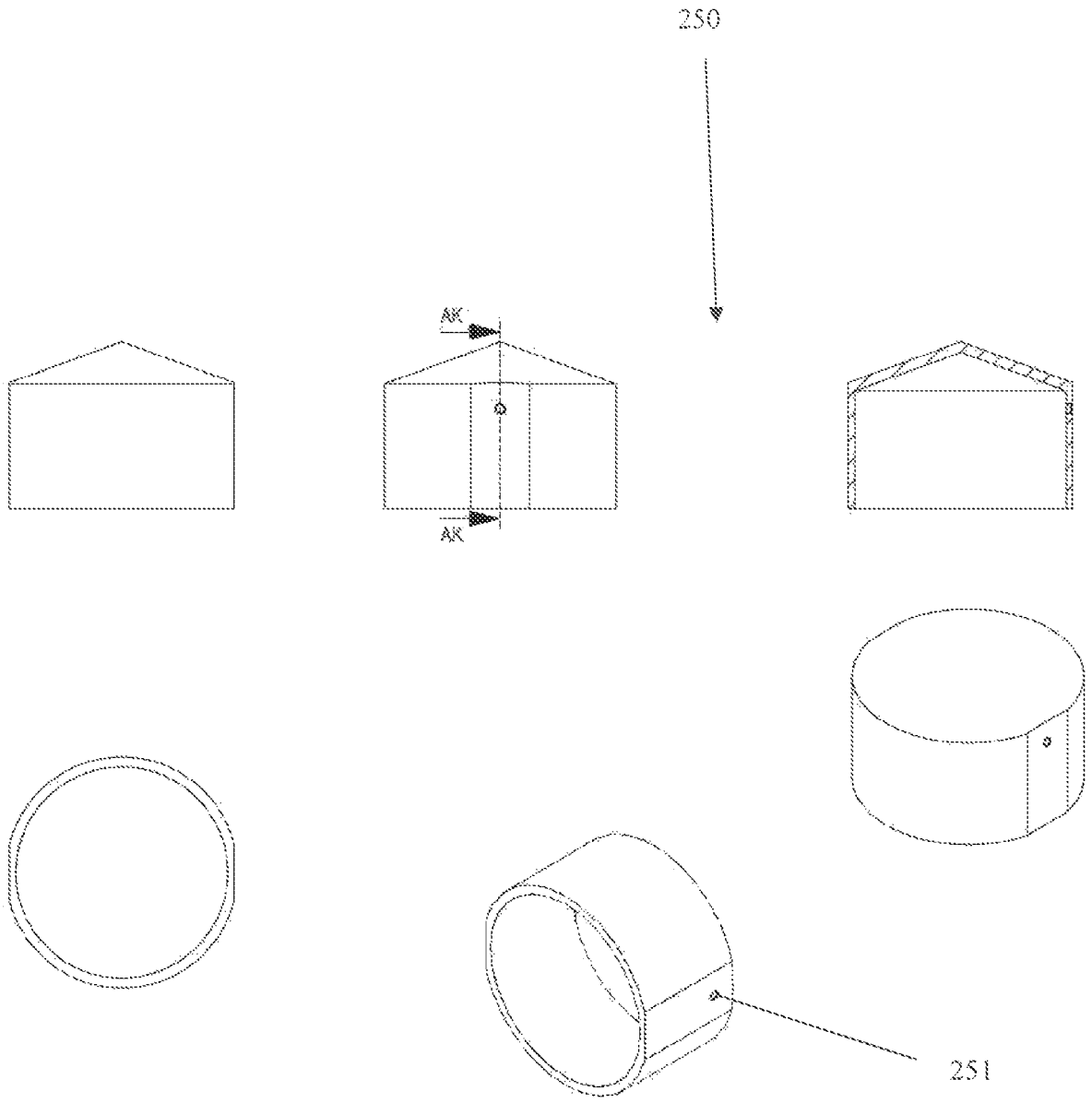
FIG. 8 shows a bottom view, two side views, a cross-sectional view, and two perspective views of a snuffer cap pipe that can be inserted into a snuffer cap, according to an embodiment.
Figure 9:
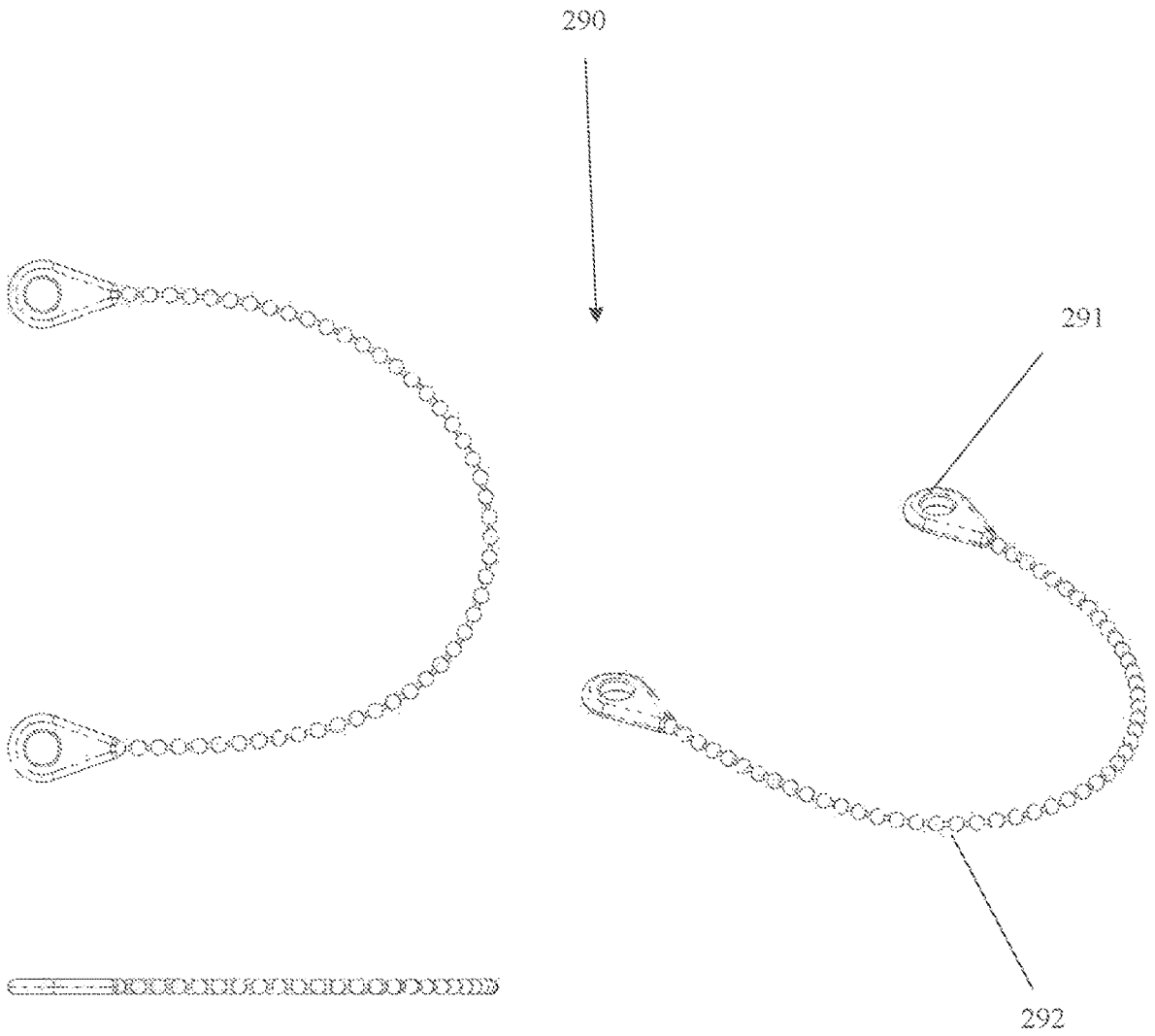
FIG. 9 shows a top view, side view, and perspective view of a chain that can be attached to a wick collar and a snuffer cap pipe, according to an embodiment.

In an embodiment, wick collar 270 can have a chain 290 (shown in FIG. 2) attached to an attachment point 272 (shown in FIG. 6) on said wick collar 270. The other end of said chain 290 can be attached to an attachment point 251 (shown in FIG. 8) on a snuffer cap pipe 250 later in the assembly process.

A wick 280 can be placed through the opening of the wick collar 270 and into the fuel reservoir 260. Said wick 280 can be partially submerged in liquid fuel in fuel reservoir 260 while said wick 280 is also extended above the top opening of wick collar 270. A grommet 320 can be placed around wick collar 270 and on top of fuel reservoir 260. Preferably, said grommet 320 can be made of a heat resistant rubber, but other heat resistant materials can be used. A cover ring 330 can be placed on the top of said grommet 320. Said cover ring 330 can have a gap that aligns with the attachment point 272 on wick collar 270, which allows for a chain 290 to pass through cover ring 330.

In an embodiment, a cover 230 can be placed over the internal components of the apparatus. Said cover 230 can be connected to a base 220 to form more of the apparatus's external housing. Said cover 230 can have an internal cavity that accommodates the apparatus's internal components. Said cover 230 can have an opening in its top. As shown in FIG. 2, preferably, the top of wick 280 will partially extend through said opening of said cover 230 and above the top surface of said cover 230.

As shown in FIG. 2, one can place a snuffer cap 240 and snuffer cap pipe 250 such that said snuffer cap 240 rests on top of a housing cover 230 and said snuffer cap pipe 250 extends through the opening of said housing cover 230 and around a wick collar 270 and wick 280; in this positioning, the apparatus can discreetly conceal that a lamp is contained within the apparatus. One can remove the snuffer cap 240 and the snuffer cap pipe 250 to expose the wick 280. When said wick 280 is exposed in said manner, one can ignite said wick 280. When one wishes to extinguish an ignited wick 280, one can place the snuffer cap 240 and the snuffer cap pipe 250 over said wick 280, as positioned and shown in FIG. 2.

In an embodiment, a snuffer cap pipe 250 may be attached to a snuffer cap 240 such that said snuffer cap 240 rests on top of a housing cover 230. Said snuffer cap 240 and snuffer cap pipe 250 may form a single component.

In an embodiment, a chain 290 can attach to an attachment point 272 on a wick collar 270 at one end of said chain 290 and to an attachment point 251 on a snuffer cap pipe 250 at the other end of said chain 290. The purpose of having said chain 290 attached to said wick collar 270 and said snuffer cap pipe 250 is so that one can remove said snuffer cap pipe 250 to expose a wick 280 and simultaneously keep said snuffer cap pipe 250 attached to the rest of the apparatus.

As shown in FIG. 3, one embodiment has a post 110, a base 220, a cover 230, and a snuffer cap 240 with dimensions that are generally four-sided with respect to horizontal dimensions. Other embodiments could include components that are shaped differently, such as components with external shapes that are circular, triangular, or hexagonal.

The invention claimed is:

1. An apparatus comprising:

a post;

a base;

a cover;

a snuffer cap;

the post disposed longitudinally adjacent to the base;

the base disposed longitudinally adjacent to the snuffer cap, wherein the cover is longitudinally fixed between the base and the snuffer cap to form an external housing;

a grommet, wherein the grommet is longitudinally fixed between an outer surface of a fuel reservoir and a bottom surface of a cover ring, and wherein the cover ring is longitudinally fixed between an outer surface of the grommet and an inner cavity of the cover;

the fuel reservoir disposed within an internal cavity of the base, a wick collar secured longitudinally to an opening on an outer surface of the fuel reservoir, wherein an opening is on an outer surface of the wick collar and extends longitudinally through a body of the wick collar to a bottom surface of the wick collar; and a wick that longitudinally extends downwards through the wick collar into the fuel reservoir and longitudinally extends upwards into the cover.

2. The apparatus of claim 1, further comprising an attachment point, wherein the attachment point is on the outer surface of the wick collar, and wherein a chain is secured to the attachment point on one end.

3. The apparatus of claim 2, in which a gap in the cover ring aligns with the attachment point of the wick collar, wherein the chain extends through the gap in the cover ring to be secured on an attachment point on a snuffer cap pipe.

4. The apparatus of claim 1, further comprising an opening in the cover, wherein the wick longitudinally extends through the opening in the cover.

5. The apparatus of claim 4, further comprising a snuffer cap pipe, in which the snuffer cape pipe longitudinally extends through the opening in the cover, and wherein the snuffer cap pipe encases the wick collar and the wick.

6. The apparatus of claim 5, wherein the snuffer cap pipe is longitudinally placed between the snuffer cap and the cover.

7. The apparatus of claim 1, further comprising an opening in the outer surface of the file reservoir extending longitudinally, wherein an outer surface of the opening in the outer surface of the fuel reservoir is threaded.

8. The apparatus of claim 1, further comprising a lamp gasket wherein the lamp gasket is secured around a base of the threading of the outer surface of the opening in the outer surface of the fuel reservoir.

9. The apparatus of claim 1, further comprising an inner cavity of the wick collar, threading lining an inner surface of the inner cavity of the wick collar.

10. The apparatus of claim 9, wherein the lamp gasket is longitudinally secured between the fuel reservoir and the wick collar.

11. An apparatus comprising:

a base;

a cover;

a snuffer cap;

an adapter that is configured to be longitudinally secured between a horizontal upper surface of a deck rail and the base using a plurality of fasteners extending into the upper surface of the deck rail through a plurality of guide holes in the adapter;

the base disposed longitudinally adjacent to the snuffer cap, wherein the cover is longitudinally fixed between the base and the snuffer cap to form an external housing;

a fuel reservoir disposed within an internal cavity of the base, a wick collar secured longitudinally to an opening on an outer surface of the fuel reservoir, wherein an opening is on an outer surface of the wick collar and extends through a body of the wick collar to a bottom surface of the wick collar; and a wick that longitudinally extends downwards through the wick collar into the fuel reservoir and longitudinally extends upwards into the cover.

12. The apparatus of claim 11, further comprising a grommet, wherein the grommet is longitudinally fixed between an outer surface of the fuel reservoir and a bottom surface of a cover ring, and wherein the cover ring is longitudinally fixed between an outer surface of the grommet and an inner cavity of the cover.

13. The apparatus of claim 12, further comprising an attachment point, wherein the attachment point is on the outer surface of the wick collar, and wherein a chain is secured to the attachment point on one end.

14. The apparatus of claim 13, in which a gap in the cover ring aligns with the attachment point of the wick collar, wherein the chain extends through the gap in the cover ring to be secured on an attachment point on a snuffer cap pipe.

15. The apparatus of claim 11, thriller comprising an opening in the cover, wherein the wick longitudinally extends through the opening in the cover.

16. The apparatus of claim 15, further comprising a snuffer cap pipe, in which the snuffer cape pipe longitudinally extends through the opening in the cover, and wherein the snuffer cap pipe encases the wick collar and the wick.

17. The apparatus of claim 16, wherein the snuffer cap pipe is longitudinally placed between the snuffer cap and the cover.

18. The apparatus of claim 11, further comprising an opening in the outer surface of the fuel reservoir extending longitudinally, wherein an outer surface of the opening in the outer surface of the fuel reservoir is threaded.

* * * * *